United States Patent [19]

Conner, Jr.

[11] 4,103,363

[45] Aug. 1, 1978

[54] METHODS OF MANUFACTURING PANTS

[75] Inventor: William R. Conner, Jr., Shelbyville, Tenn.

[73] Assignee: Stahl-Urban Company, Brookhaven, Miss.

[21] Appl. No.: 712,711

[22] Filed: Aug. 9, 1976

[51] Int. Cl.[2] ..... A41D 1/07; A41D 27/00

[52] U.S. Cl. ..... 2/227; 2/243 R; 26/69 A; 264/292

[58] Field of Search ..... 2/227, 243 R, 409, 69; 66/177; 38/144; 264/289, 292; 26/69 R, 69 A

[56] References Cited

U.S. PATENT DOCUMENTS

| | | | |
|---|---|---|---|
| 3,641,589 | 2/1972 | Bryant | 2/409 |
| 3,671,352 | 6/1972 | Andersen | 2/409 |
| 3,763,499 | 10/1973 | Bartos et al. | 2/227 |
| 3,819,638 | 6/1974 | Ogawa et al. | 264/292 |

FOREIGN PATENT DOCUMENTS

| | | | |
|---|---|---|---|
| 2,097,617 | 3/1972 | France | 2/227 |
| 2,421,518 | 11/1975 | Fed. Rep. of Germany | 2/227 |

OTHER PUBLICATIONS

"Current State and Further Development of Moulding"; F. Machacek; in First International Symposium on Garment Molding Technology; 50 p.; Oct. 15–16, 1974.

*Primary Examiner*—H. Hampton Hunter
*Attorney, Agent, or Firm*—Koenig, Senniger, Powers and Leavitt

[57] ABSTRACT

Methods of manufacturing pants from heat-settable textile material, with molding of the material for a good fit, in which two flat tubes of such material are assembled, seamed to form a crotch seam, applied to a mold shaped to impart appropriate form to the tubes for a better fit, and heated to set the tubes in the form of the mold; and the molds used in carrying out said methods. According to a first embodiment, the material in the crotch section of the tubes is left intact until after molding, being then cut out. According to a second embodiment, the material in the crotch section of the tubes is cut out before molding.

13 Claims, 16 Drawing Figures

METHODS OF MANUFACTURING PANTS

BACKGROUND OF THE INVENTION

This invention relates to methods of and molds for manufacturing pants, and more particularly to methods of making a pair of pants with molding of the material from which the pants are made, and the molds used in carrying out the methods.

The invention relates especially to methods of making a pair of pants using heat-settable material (e.g., knitted polyester material) with molding of the material, and molds used in carrying out the methods. Reference may be made to U.S. Pat. Nos. 3,763,499, issued Oct. 9, 1973 and 3,819,638, issued June 25, 1974 for disclosures in the same general field as the present invention. It is particularly directed to methods of making ladies' pants (slacks) though not limited to such pants, ladies' pants with a good fit being more difficult to make than men's pants. Until recently, the manufacture of pants has involved relatively standard garment manufacturing procedures including cutting of pieces with curved edges to form the pants and sewing of the pieces with curved seams and/or darts, to make the pants have a better fit. Such procedures are relatively time-consuming and costly. Cutting with curved edges and/or sewing with curved seams is wasteful of material, and forming darts is labor-intensive. The aforesaid patents disclose techniques for manufacturing pants (U.S. Pat. No. 3,819,638 also discloses techniques for manufacturing other garments) involving molding for a better fit with reduction of cutting and sewing operations. This invention carries this art further.

SUMMARY OF THE INVENTION

Among the several objects of this invention may be noted the provision of improved and simplified methods of making a pair of pants which, while effecting reduction in the cutting and sewing operations needed so as to reduce cost, enable production of goodfitting pants; the provision of such methods which utilize molding to accomplish good fit; the provision of such methods in which creases are set in the pants legs; the provision of such a method which enables pants to be produced from material in the "greige" (i.e., material in an undyed gray state) without adversely affecting the capability of uniformly dyeing the pants; and the provision of molds for carrying out said methods.

Generally, the method of this invention utilizes two flat tubes of heat-settable textile material, each of which is to form one leg of the pants and portions of which are to form the upper part of the pants, each tube having opposed walls one of which is to form the inside of the respective leg of the pants and the other of which is to form the outside of said respective leg. In carrying out the method the two tubes are assembled with the said one wall of one tube in face-to-face relation with the said one wall of the other tube, one end of the resultant assembly constituting its waist end. The said one wall of one tube is seamed to the said one wall of the other tube on a line following the form of the crotch extending from a point at or adjacent one corner of the waist end of the assembly to a point at or adjacent the other corner of the waist end of the assembly, the resultant seam defining a crotch seam for the pants extending generally from the center of the back of the waist end of the pants to the center of the front of the waist end of the pants. The seamed-together tubes are applied to a molding form having a section for molding at least the outer side portions of the two tubes adjacent their waist end to conform to the shape of the torso at the hips, said form having leg portions extending from said section, by drawing the waist end portion of the tubes over said leg portions and then over said section, the latter being formed to stretch out said outer side portions of said tubes. Heat is applied to the tubes while on said molding form to set the tubes in their shape on the form, and the tubes are thereafter removed from the form.

Generally, a molding form of this invention has a hip section and leg portions extending from the hip section, the form being adapted to have the above-described tubes applied thereon with one tube on one leg portion, the other tube on the other leg portion and the waist end portion of the tubes on said hip section. The hip section is of such shape as to bulge out the outer side of one tube and the outer side of the other tube adjacent said one end of the tube, and said leg portions of the molding form comprise flat members extending from the hip section generally in front-to-rear vertical central leg planes on opposite sides of the front-to-rear vertical central plane of the hip section.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
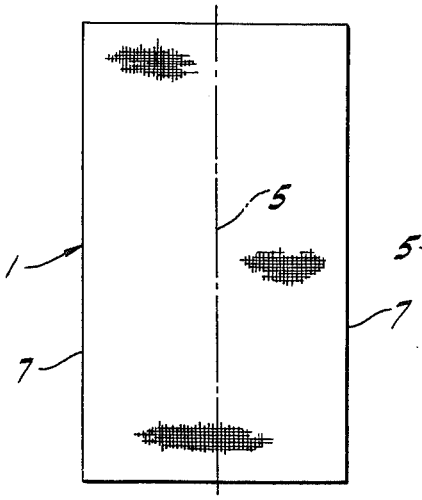
FIG. 1 is a view of a rectangular blank of textile material from which a tube utilized in carrying out the invention is made.

Referring to the drawings, first more particularly to FIGS. 1–10 illustrating a first embodiment, there is indicated at 1 in FIG. 1 a flat rectangular blank of heat-settable (thermoplastic) textile material. This may be a knit material, for example, knit entirely of polyester yarn, or of nylon yarn, or it may comprise a blend of polyester and natural fiber yarns, or a blend of polyester and non-thermoplastic synthetic yarn, or other blends. Essentially, however, the material must be one that is capable of being molded to a three-dimensional shape by being stretched on a suitable mold and set in the three-dimensional shape by application of heat (e.g., by being steam-heated in an autoclave).

Figure 2:
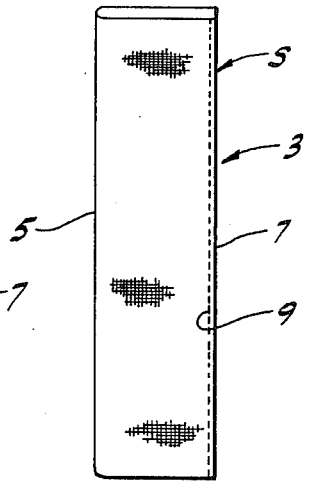
FIG. 2 is a view of a tube made from the FIG. 1 blank.

As shown in FIG. 2, the rectangular blank of material 1 is formed into a flat tube 3 with a longitudinal seam S by folding it in half along its longitudinal center line at 5, bringing its longitudinal margins 7 together, and sewing the margins 7 together by a line of stitching such as indicated at 9. Two of these tubes are utilized to make a pair of pants, each of the two tubes forming one-half of the pair of pants, each tube providing one of the legs and half of the upper portion of the pair of pants.

Figure 3:
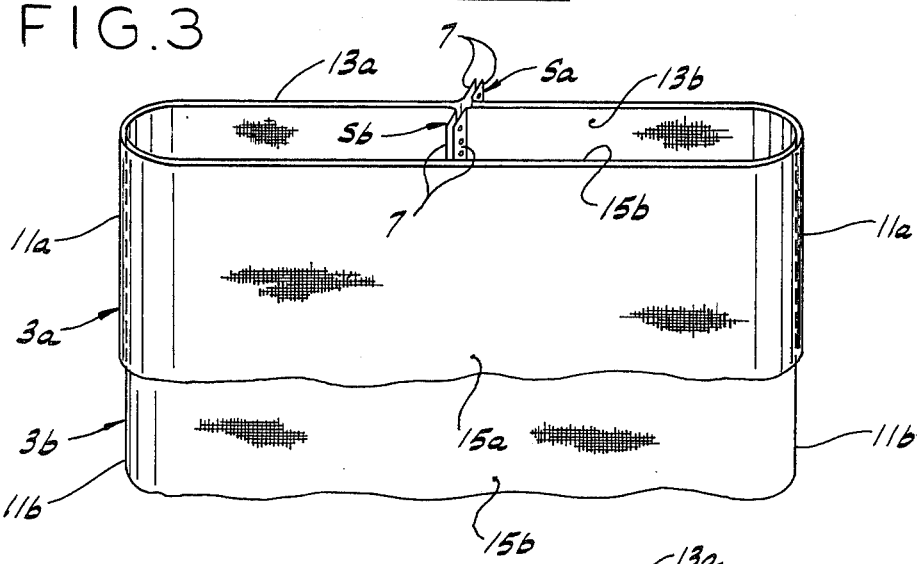
FIG. 3 is a view showing how two of the FIG. 2 tubes are initially assembled in carrying out the invention.

One of the pair of tubes 3 which is to form the pair of pants is refolded as illustrated in FIG. 3 to have its longitudinal seam extend generally centrally of one wall of the tube, the margins 7 of the tube in the seam extending outwardly from this wall. As shown in FIG. 3 this tube is specially designated 3*a* and its longitudinal seam is specially designated S*a*. Its side folds are each designated 11*a*, its seamed wall is designated 13*a* and its unseamed wall (opposite wall 13) is designated 15*a*. The other of the pair of tubes which is to form the pair of pants is everted (turned inside out) and refolded as illustrated in FIG. 3 to have its longitudinal seam extend generally centrally of one wall of the tube, the margins 7 of the seam extending inwardly from this wall. As shown in FIG. 3, this second tube is specially designated 3*b* and its horizontal seam is specially designated S*b*. Its side folds are each designated 11*b*, its seamed wall is designated 13*b* and its unseamed wall is designated 15*b*.

Also as illustrated in FIG. 3, the tubes 3*a* and 3*b* are assembled with tube 3*b* inside 3*a*, one extending the length of the other, with the seamed walls 13*a* and 13*b* of the two tubes in face-to-face relation and with seams S*a* and S*b* of the two tubes generally aligned, but with the seam S*a* of tube 3*a* on the outside of tube 3*a* and seam S*b* of tube 3*b* on the inside of tube 3*b*.

Figure 4:
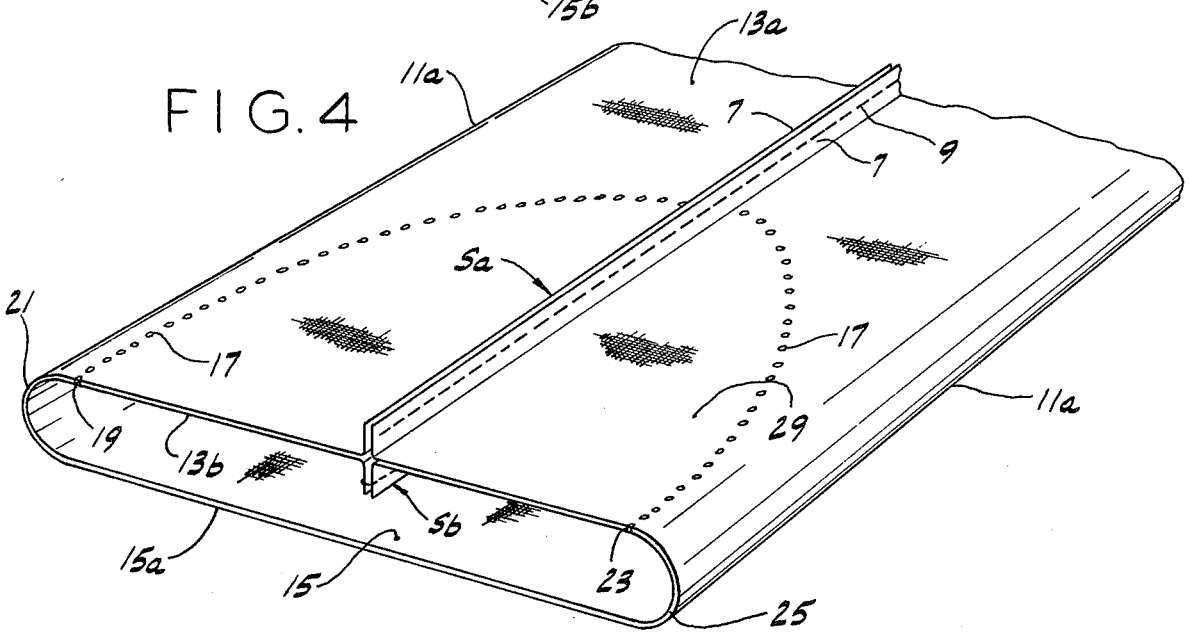
FIG. 4 is a view showing how the two tubes assembled as shown in FIG. 3 are seamed on the crotch line.

As shown in FIG. 4, walls 13*a* and 13*b* (the seamed walls) of the tubes 3*a* and 3*b* are seamed together as indicated at 17 on a line following the form of the crotch extending from a point 19 at or adjacent one corner 21 of one end of the assembly which constitutes its waist end (so called because it becomes the waist end of the pair of pants which is to be formed) to a point 23 at or adjacent the other corner 25 of the stated waist end of the assembly. The seam 17 defines a crotch seam for the pants which extends generally from the center of the back of the waist end of the pants to the center of the front of the waist end of the pants.

Figure 5:
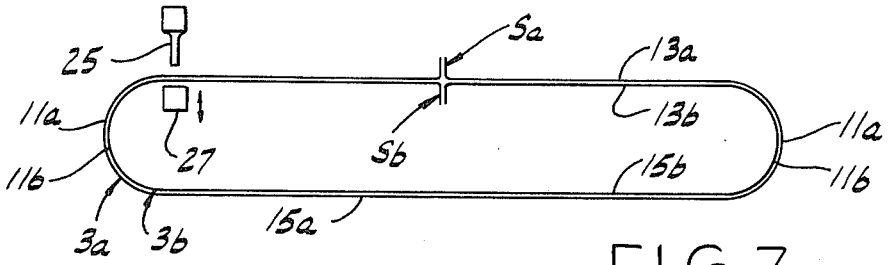
FIG. 5 is an end view of the tube assembly showing how the seaming is effected ultrasonically.

As illustrated in FIG. 5, the seam 17 is formed by feeding the face-to-face walls 13*a* and 13*b* of the tubes 3*a* and 3*b* between the horn 25 and anvil 27 of an ultrasonic stitching device such as a machine of the type shown in U.S. Pat. No. 3,666,599 issued May 30, 1972. The stitching device may employ a wheel such as the wheel shown at 24 for the anvil in said patent, with the rim of the wheel formed to provide a pattern similar to that shown fourth from the left in FIG. 3 of said patent. Or it may employ a single spot-seal anvil which is reciprocated up and down as the work is fed between the horn and the anvil, as indicated by the arrows alongside the anvil in FIG. 5, the anvil being at the end of an arm adapted to reach into the inside tube 3*b* of two tubes 3*a* and 3*b* from the waist end of the assembled tubes. The seam at 17 is in the nature of a basted seam for basting the tubes to hold them together for subsequent operations to be described. One of the subsequent operations (as will appear) is a permanent sewing of the tubes along or adjacent the basted seam 17, and the cutting away of the section 29 of the walls 13*a* and 13*b* of the tubes bounded by the seam 17.

Figure 6:
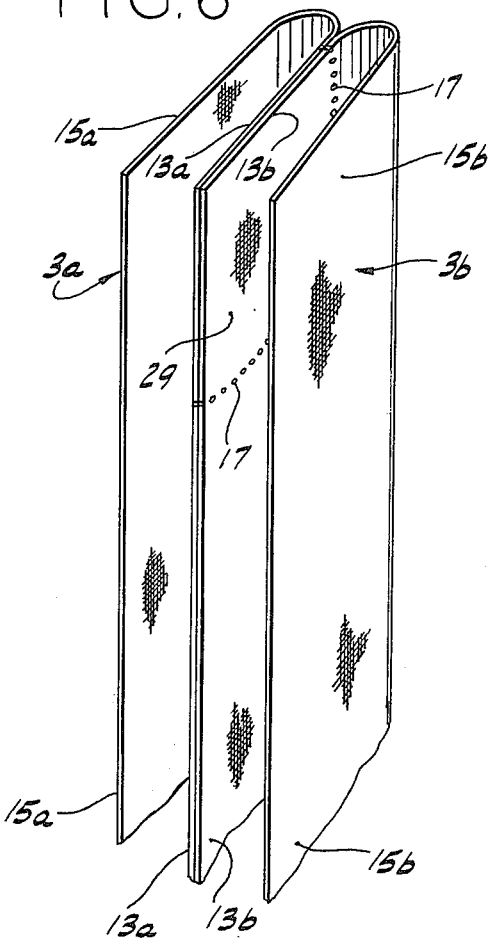
FIG. 6 is a perspective, with parts broken away, showing how the two tubes, seamed together on the crotch line, are disposed in their side-by-side final relation, ready for being molded.

After the walls 13*a* and 13*b* of the tubes 3*a* and 3*b* have been seamed together on line 17, the inside tube 3*b* is pulled out of the outside tube 3*a* at the waist end of the garment, leaving the seam S*b* on the inside of the tube 3*b*, the tube 3*a* is turned inside out to bring the seam S*a* to the inside of the tube 3*a*, and the two tubes are disposed side-by-side as shown in FIG. 6 in the position of the two legs of a pair of pants, joined together at the upper or waist end of the assembly by the basted crotch seam 17. In this disposition of the tubes, the seams S*a* and S*b* are on the inside of the respective tubes, thereby constituting inseams of the legs of the pants.

Figure 7:
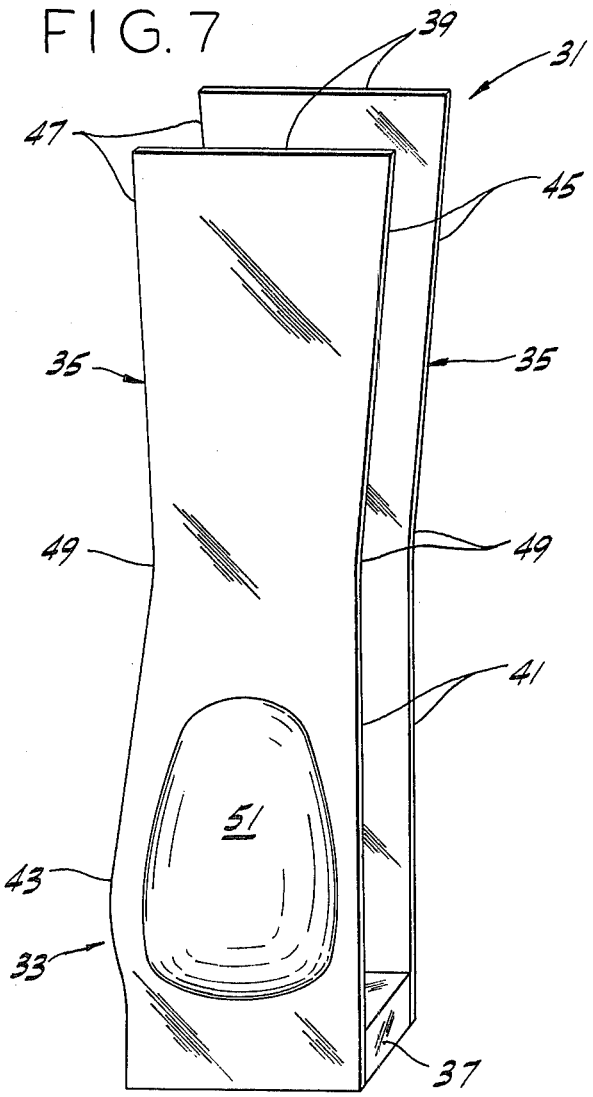
FIG. 7 is a perspective of a molding form of the invention used in carrying out a first embodiment of the method of this invention.
Figure 8:
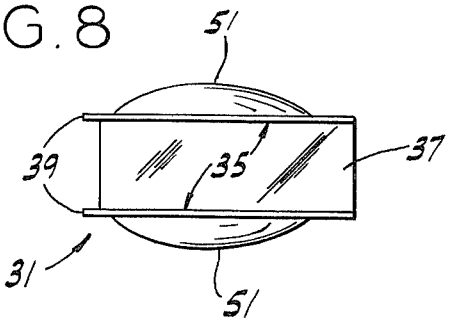
FIG. 8 is a plan of the FIG. 7 form.

At 31 in FIGS. 7 and 8 is generally indicated a molding form having a hip section 33 for molding at least the outer side portions of the two tubes 3*a* and 3*b* adjacent their waist end to conform to the shape of the torso at the hips, and having leg portions 35 extending from section 33. More particularly, the molding form 33 comprises a rectangular base block 37 and a pair of elongate side plates each designated 39 secured at one end (their lower end as shown in FIG. 7) to the sides of the base and extending up from the base in spaced side-by-side generally parallel relation. Each side plate has a lower section formed with one of its edges, designated 41, generally straight and vertical and with its other edge 43 convexly curved generally to conform to the shape of the torso at the upper rear of the pants. Above the lower section, the edges may flare out as indicated at 45 and 47 from a knee region 49 of the plates. The lower section of each side plate 39 is provided on the outside thereof with a bulge 51 which bulges outwardly from the plate, being shaped generally to conform to the shape of the human torso at the hips. As appears in FIGS. 9 and 10, each bulge 51 is formed as a separate part from the respective plate, secured to the respective plate, although it could be formed as an integral part of the plate. Each plate 39 extends for a distance corresponding to the length of the legs of the assembly of tubes 3*a* and 3*b* and has a width greater than the width of the legs of the assembly generally at all points along the length of the plates for stretching each leg girthwise generally throughout its length.

Figure 9:
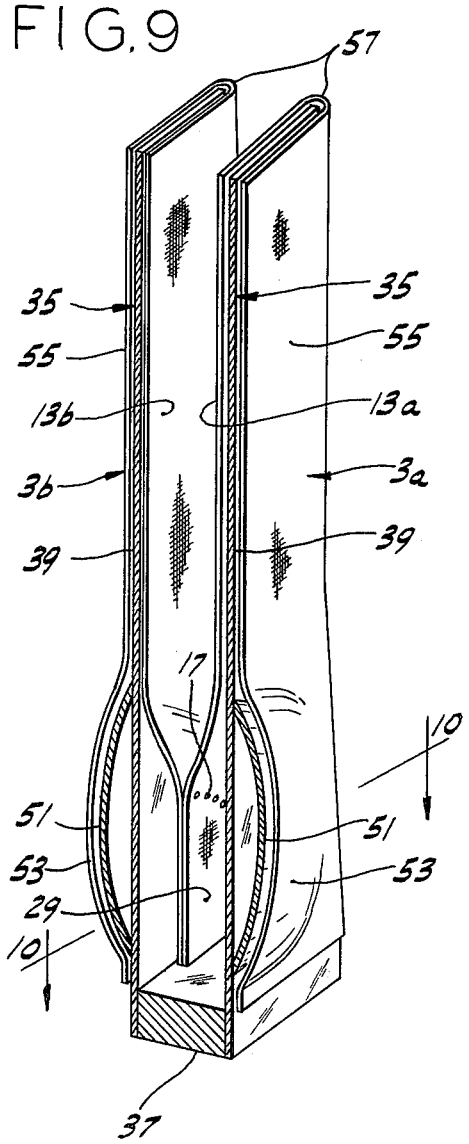
FIG. 9 is a perspective, with parts broken away and shown in section, showing the tube assembly on the molding form of FIG. 7.
Figure 10:
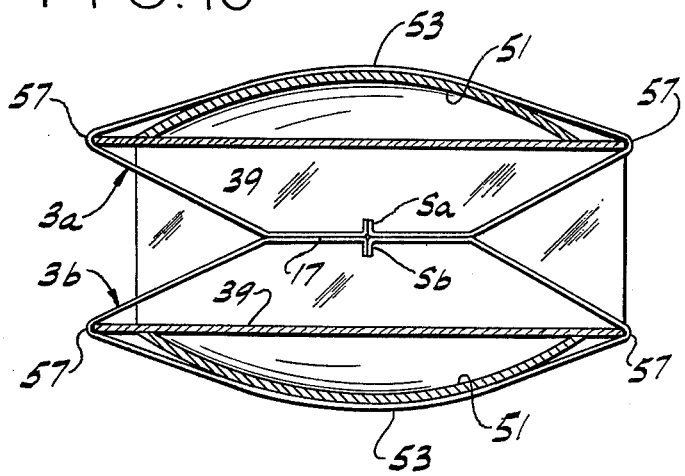
FIG. 10 is a section generally on line 10—10 of FIG. 9.
Figure 11:
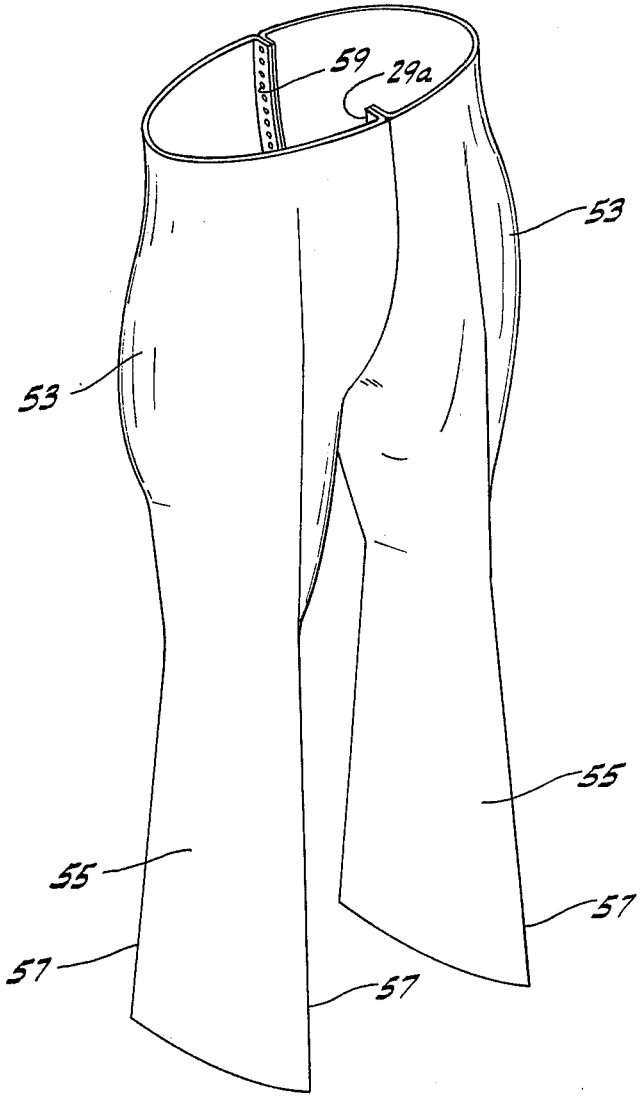
FIG. 11 is a view of a pair of pants as molded and finished in the crotch section.

In accordance with this invention, the seamed-together tubes 3*a* and 3*b* disposed in their relationship of FIG. 6 are applied to the molding form 31 by drawing the waist end portion of the tubes (where the tubes are joined along the basted crotch seam 17), over the leg portions 35 of the form and then over hip section 33 of the form as illustrated in FIG. 8 to apply the waist end portion of the assembly of tubes to the hip section 33 and the legs to the flat members 35. The bulges 51 of the molding form 31 stretch out the outer side portions of the tubes 3*a* and 3*b* as indicated at 53 in FIGS. 9 and 10, and leg portions 35 of the molding form stretch the leg portions 55 of the tubes flat as illustrated in FIG. 9 in such manner as to form creases for the legs of the pants as indicated at 57 in FIGS. 9 and 11. The legs of the assembly of tubes extend generally for their full length on members 35 and are stretched flat thereon. The ends of the leg portions of the tubes may be suitably clamped at their ends to the plates 39 and the waist end portion of the tubes may be suitably clamped to the waist end of the molding form.

Heat is then applied to the tubes 3*a* while on the molding form 31 to set the tubes in their shape on the form with the outer side portions 53 of the tubes at the hip portions thereof bulged out in conformance with the shape of the torso at the hips and with the leg portions 55 of the tubes in flat creased pants leg form. The heat sets creases 57 in the pants. Heat may be applied by steam heating in an autoclave, particularly where the material is one requiring moist heat for setting the material, or by dry heating in an oven, at a suitable temperature and for a suitable time for permanently setting the tubes in their molded form. Thus, for example, polyester tubes may be dry heated at 280° - 350° F. for from two to three minutes, or more, or heated with steam from 240° - 350° F. for from two to three minutes or more. Nylon tubes require the steam-heat treatment.

Following the molding operation as above described, the tubes are removed from the molding form 31 by pulling them off the upper ends of the plates 39 of the form. Section 29 of the tubes, constituted by a portion of wall 13*a* of tube 3*a* and a portion of wall 13*b* of tube 3*b* left intact for and during the molding of the tubes, is cut out simultaneously with permanent stitching of the tubes generally along line 17. The permanent stitching is indicated at 59 in FIGS. 11 and 12, which show the pants in their completed form, except for the ultimate provision of an elastic waistband (not shown) or a fly with a zipper (not shown), for example. It is to be understood, however, that the waistband may be stitched to the waist end of the tubes before the heat setting (and, indeed, this may be preferable). It is also to be understood that the tubes may be cuffed before heat setting.

Figure 14:
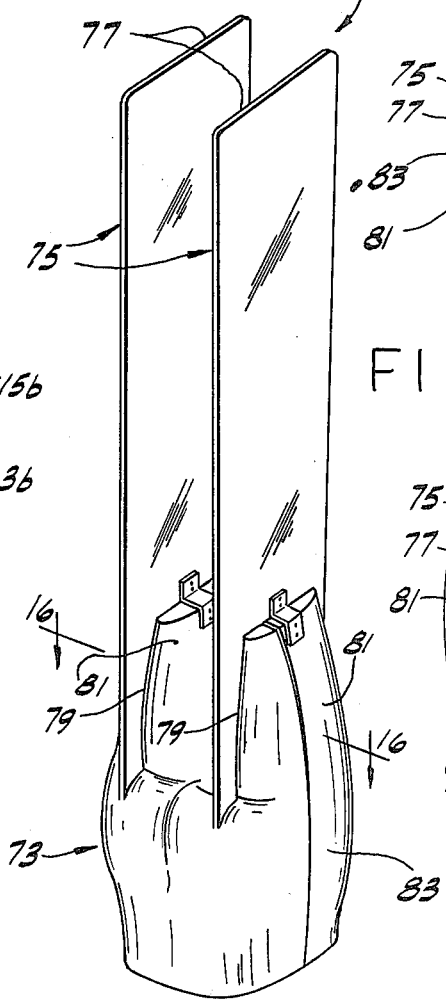
FIG. 14 is a perspective of a second embodiment of the molding form used in carrying out a second method of the invention.
Figure 15:
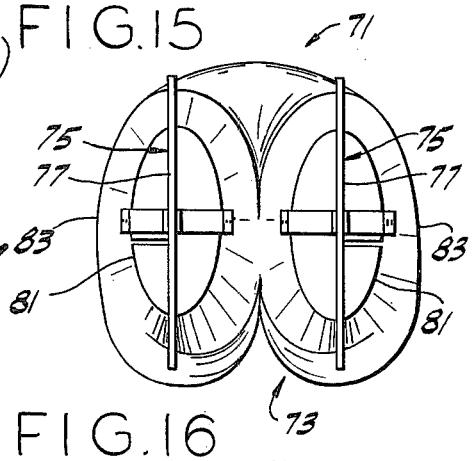
FIG. 15 is a plan of FIG. 14.
Figure 16:
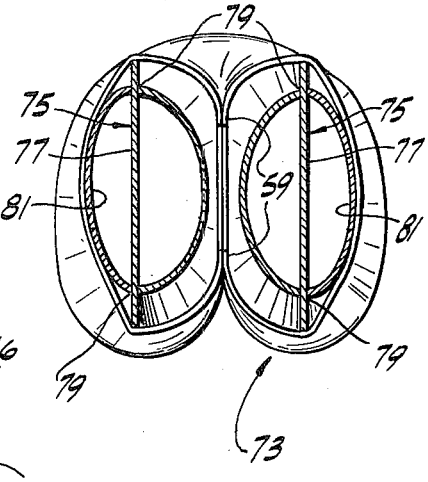
FIG. 16 is a section generally on line 16—16 of FIG. 14 showing a pair of tubes stretched on the molding form of FIG. 14.

Referring now to FIGS. 14–16, there is illustrated a second embodiment of the invention utilizing a different molding form designated in its entirety by the reference numeral 71 having a section 73 for molding the hip portion of the human figure; more particularly, it consists of the hip and thigh section of a typical female form mannequin. The leg portions 75 of the molding form are constituted by elongate plates 77 which are secured in slots 79 in the thigh portions 81 of section 73, and which project from the ends of the thigh portions 81. The slots 79 are located generally in the front-to-rear vertical central planes of the thigh portions 81 of section 73 and thus the plates are located generally in such planes. Section 73, being modeled upon the human torso, has bulged-out side portions 83 (conforming to the shape of the torso at the hips).

Figure 12:
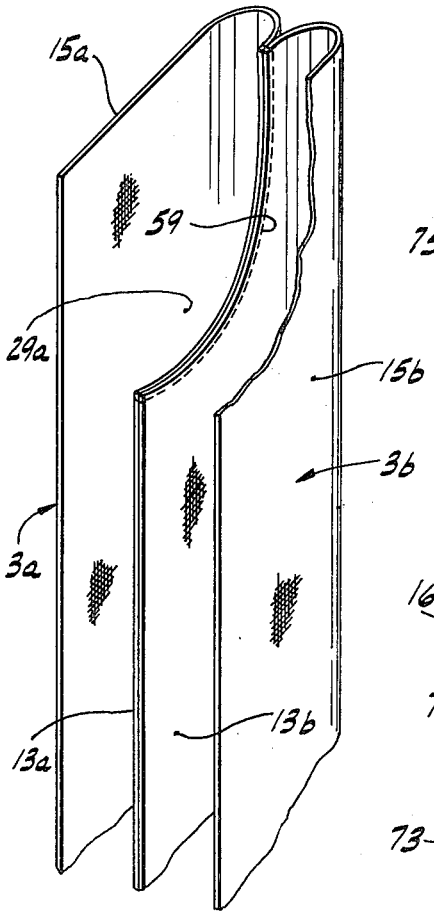
FIG. 12 is a perspective, with parts broken away, showing the upper portion of the pants and showing how they are finished in the crotch section.

In accordance with the second embodiment of the invention, an assembly of tubes 3*a* and 3*b* is made just as in the first embodiment except that the seaming at 17, instead of being basting, is a permanent stitching and, instead of leaving section 29 intact for the molding operation, section 29 is cut out, preferably concomitantly with the permanent stitching at 17 before the tubes are applied to the molding form. Thus, the assembled tubes 3*a* and 3*b* in this instance appear generally as shown in FIG. 12, and the permanent crotch stitching for the second embodiment of the invention may be designated 59, the same as in FIG. 12. The space in the latter where section 29 has been cut out is indicated at 29*a* (see also FIG. 11). The tubes 3*a* and 3*b* are applied to the form 71 by drawing the waist end portion of the tubes over the leg portions 75 of the form and thence over the hip and thigh section 73 of the form. The waist end portion of the tubes is stretched out around section 73 of the form, including stretching out of the outer side portions of the tubes by the side portions 83 of section 73 (similarly to the stretching out of the side portions of the tubes by the bulges 51 in the first embodiment). After heat-setting of the tubes on the form 71 similar to the heat-setting of the tubes on the form 31 as above described, the tubes are removed and constitute the completed pants (no further crotch stitching and no cutting out at the crotch being needed at this point), except, again, for the ultimate provision of an elastic waistband (not shown), or a fly with a slide fastener (not shown), if the waistband has not been applied prior to the heat-setting.

In each of the two embodiments of the invention as above described, the pants are molded, particularly at the hips, to conform generally to the shape of the human torso at the hips, and thus tend to have a good fit on the wearer (much better than if they were not so molded). This is particularly important for ladies' pants (slacks). It will be observed that the shaping is obtained by molding, without any cutting of curved edges and sewing with curved seams and/or darts, and involves less skilled labor and less waste of material, while at the same time enabling consistency in quality of production.

The first embodiment of the invention is specially suitable for the manufacture of pants from material in the greige, i.e., in an undyed state, as may be desirable where it is desired to stock an inventory of undyed pants and dye them as needed for seasonal requirements. This is because, with section 29 intact during the molding operation, the pants may be molded with nothing in contact with the material in the region of the crotch seam. In this regard, it has been found that if pants in the griege are molded with shaping bars or the like in contact with the pants at the crotch seam region (as needed when section 29 is initially cut out), the molded pants when thereafter dyed may have an unsightly streaked appearance where so contacted. The second embodiment, in which there is contact during molding of the pants between the crotch seam region and section 73 of the form is more suitable for pre-dyed material, and while it is not so suitable for material in the greige, it provides an even better fit for the pants than the first embodiment.

Figure 13:
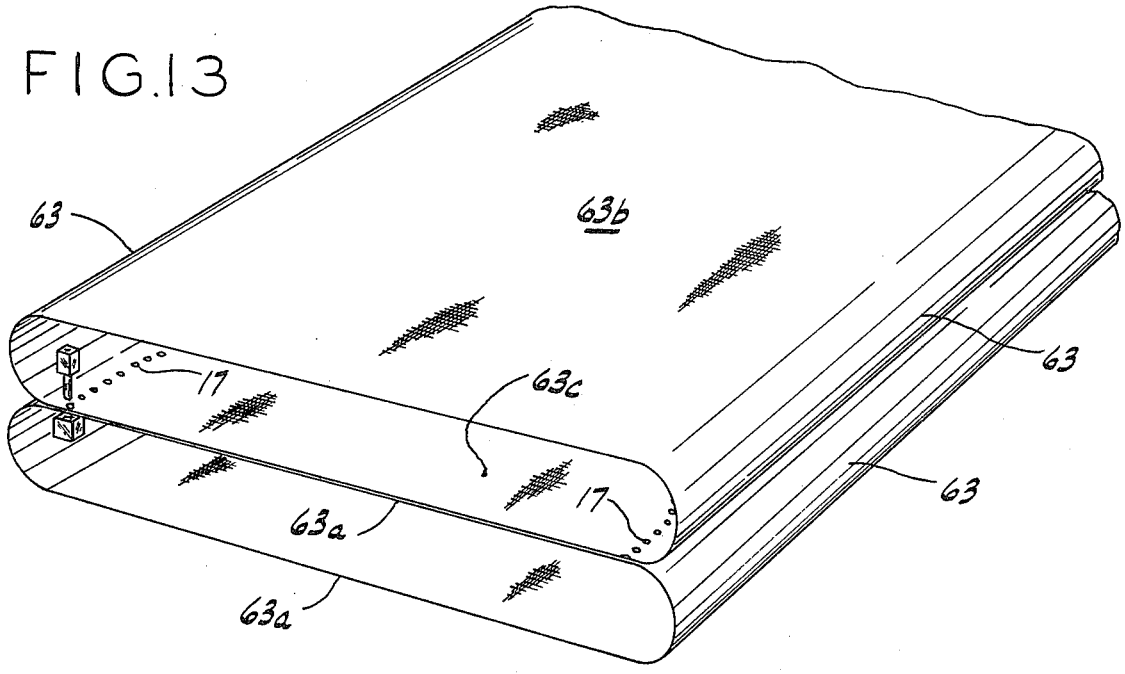
FIG. 13 is a view illustrating utilization of seamless tubes and an alternative mode of seaming the tubes together.

FIG. 13 illustrates a modification, applicable to either of the two embodiments of the invention herein disclosed, involving the initial assembly of the two tubes 3*a* and 3*b* in side-by-side relation, rather than with tube 3*b* inside tube 3*a*, and with the outside face of one wall of tube 3*a*, namely the outside face of wall 13*a*, engaging the outside face of one wall of the other tube 13*b*, namely, the outside face of wall 13*b*. Then walls 13*a* and 13*b* are seamed together as at 17 for the first embodiment, or as at 59 for the second embodiment. FIG. 13 also shows the tubes 3*a* and 3*b* as seamless tubes, e.g., seamless knit tubes, instead of seamed tubes, and it is to be understood that such seamless tubes may be assembled one inside the other and crotch-seamed in the same manner as shown for the seamed tubes in FIGS. 4 and 5, and in FIG. 12.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. The method of making a pair of pants comprising assembling component parts to form the legs and the upper part of the pants, one end of the resultant assembly constituting its waist end, each component part being of heat-settable textile material;

applying the assembly to a molding form having a hip section for molding the outer side portions of the assembly adjacent its waist end to conform to the shape of the torso at the hips and leg portions extending from said hip section, said hip section being shaped to conform to the hip portion of the human figure and the leg portions comprising flat members extending from the hip section generally in front-to-rear vertical central leg planes on opposite sides of the front-to-rear vertical central plane of the hip section, said flat members extending for a distance corresponding to the length of the legs of said assembly and having a width greater than the width of the legs of said assembly generally at all points along the length of said flat members for stretching each leg girthwise generally throughout the length, said applying of the assembly to said molding form being carried out by drawing the waist end portion of the assembly over said leg portions and then over said hip section to apply said waist end portion of the assembly to said hip section and the legs of said assembly to said flat members, the outer side portions of the assembly adjacent its waist end being bulged out by said hip section and the legs of the assembly extending generally for their full length on said flat members and being stretched flat on said flat members;

applying heat to the assembly while on said molding form with said outer side portions of the assembly so bulged out and with the legs of the assembly stretched flat generally throughout their length on said flat members to set the assembly with said outer said portions of the assembly so bulged out and with said legs of the assembly having pants leg creases; and removing the assembly from the molding form.

2. The method of claim 1 wherein each of said component parts comprises a flat tube of said heat-settable textile material, each of which is to form one leg of the pants and portions of which are to form the upper part of the pants, each tube having opposed walls one of which is to form the inside of the respective leg of the pants and the other of which is to form the outside of said respective leg, and wherein the said one wall of one tube is seamed to the said one wall of the other tube on a line following the form of the crotch extending from a point at or adjacent one corner of the waist end of the assembly to a point at or adjacent the other corner of the waist end of the assembly, the resultant seam defining a crotch seam for the pants extending generally from the center of the back of the waist end of the pants to the center of the front of the waist end of the pants and removing the portion of the tubes bounded by the crotch seam and the waist end.

3. The method of claim 2 wherein the hip section is in the shape of the hip portion of the human figure having thigh portions in the shape of the thighs of the human figure extending from the hip section, said leg portions constituting plates projecting from the ends of the thigh portions, the upper portions of the legs of said assembly being stretched on said thigh portions.

4. The method of claim 2 wherein the portion of the said one wall of the one tube and the portion of the said one wall of the other tube bounded by the said seam is left intact for and during the molding of the assembly and is cut out after removal of the tubes from the molding form.

5. The method of claim 4 wherein the tubes are initially basted generally along said line, applied to the molding form with said tubes so basted, and premanently stitched and cut generally along said line after removal of the tubes from said molding form.

6. The method of claim 5 wherein the tubes are ultrasonically basted.

7. The method of claim 2 wherein the said seaming is permanent and the portion of the said one wall of the one tube and the portion of the said one wall of the other tube bounded by the said seam is cut out before the tubes are applied to the molding form.

8. The method of claim 2 wherein the tubes are assembled with one tube inside the other and seamed with one tube inside the other, the inside tube being pulled out of the outside tube after the said seaming of the tubes.

9. The method of claim 2 wherein the tubes are assembled side-by-side with the outside face of one wall of one tube engaging the outside face of one wall of the other tube, these said one walls of the tubes being seamed together on the said line.

10. The method of claim 2 wherein each tube is formed from a generally rectangular blank of heat-settable textile material by folding the blank generally in half along its longitudinal center line, bringing its longitudinal margins together and sewing said margins together to form a longitudinal tube seam.

11. The method of claim 10 wherein the tubes are assembled with the seam of each tube extending generally centrally along one wall of the tube constituting its seamed wall, with the seamed walls of the tube in face-to-face relation, said seamed walls being seamed together along the said line.

12. The method of claim 11 wherein the tubes are assembled with one tube inside the other and seamed along the said line with one tube inside the other, the inside tube being pulled out of the outside tube after the said seaming of the tubes, and the tubes then being disposed with their longitudinal seams on their insides for the molding of the tubes.

13. The method of claim 12 wherein the tubes are initially assembled with the longitudinal seam of the inside tube on the inside and the longitudinal seam of the outside tube on the outside, the longitudinal seam of the inside tube remaining on the inside when the inside tube is pulled out of the outside tube, and the outside tube being turned inside out to bring its longitudinal seam to the inside of the outside tube.

* * * * *